US005652554A

United States Patent [19]

Krieg et al.

[11] Patent Number: 5,652,554

[45] Date of Patent: Jul. 29, 1997

[54] QUASI-OPTICAL COUPLER WITH REDUCED DIFFRACTION

[75] Inventors: Jean-Michel Krieg, Fontenay Sous/Bois, France; Christos Iatrou, Athenes, Greece

[73] Assignee: Thomson Tubes Electroniques, Velizy, France

[21] Appl. No.: 531,303

[22] Filed: Sep. 20, 1995

Related U.S. Application Data

[63] Continuation of Ser. No. 260,740, Jun. 15, 1994, abandoned.

[30] Foreign Application Priority Data

Jun. 15, 1993 [FR] France ..... 93 07186

[51] Int. Cl.[6] ..... H01P 1/16; H01J 23/54

[52] U.S. Cl. ..... 333/21 R; 315/5

[58] Field of Search ..... 315/4, 5; 331/79; 333/21 R

[56] References Cited

U.S. PATENT DOCUMENTS

| | | | |
|---|---|---|---|
| 5,187,409 | 2/1993 | Ito | 331/79 X |
| 5,302,962 | 4/1994 | Rebuffi et al. | 333/21 R X |

FOREIGN PATENT DOCUMENTS

| | | | |
|---|---|---|---|
| 454540 | 10/1991 | European Pat. Off. | 315/5 |
| 117201 | 5/1990 | Japan | 333/21 R |
| 3241901 | 10/1991 | Japan | 315/5 |

OTHER PUBLICATIONS

International Journal of Electronics. vol. 70, No. 5, May 1991, London, GB, pp. 989–1004. M. Otsuka, et al. Development of mode converters for 28GHz electron cyclotron heating system.

Radio Engineering and Electronic Physics. vol. 20, No. 10, Oct. 1975, Washington US pp. 14–17. S.N. Vlasov et al. Transformation of a whispering gallery mode, propagating in a circular waveguide, into a beam of waves.

International Journal of Electronics. vol. 61, No. 6, Dec. 1986, London, GB, pp. 1109–1133. J.L. Doane. Polarization converters for circular waveguide modes.

*Primary Examiner*—Benny T. Lee

*Attorney, Agent, or Firm*—Oblon, Spivak, McClelland, Maier & Neustadt, P.C.

[57] ABSTRACT

A microwave coupler with improved efficiency receives microwave energy in a principal mode TEm,n (m and n being whole numbers and n being not zero) and gives a quasi-optical energy beam. It comprises a mode converter that receives energy in the principal mode and converts a part of it into an auxiliary mode TEp,q (with p and q being whole numbers, q close to one and not zero, p greater than q). The energy in the principal mode and in the auxiliary mode get propagated in a radiator and emerge in the form of the quasi-optical beam by an aperture that coincides with a minimum electrical field resulting from the electrical field of the principal mode and the electrical field of the auxiliary mode. The disclosure has applications notably to the field of gyrotubes.

8 Claims, 4 Drawing Sheets

QUASI-OPTICAL COUPLER WITH REDUCED DIFFRACTION

This application is a Continuation of application Ser. No. 08/260,740, filed on Jun. 15, 1994, now abandoned.

BACKGROUND OF THE INVENTION

1. Field of the Invention

The present invention relates to a quasi-optical coupler with reduced diffraction. This coupler can be used notably at the output of microwave tubes working at high frequency and power, such as gyrotubes. Gyrotrons and gyroklystrons notably belong to this class of tubes.

Tubes of the gyrotron class use the interaction of an electron beam with the component transversal to the axis of propagation of the electron beam of a microwave. This interaction takes place in a cavity in the form of a hollow cylindrical conductor. In a hollow conductor, the distribution of the electrical and magnetic fields is a function, inter alia, of the frequency. A practically lossless propagation of the microwave may take place if the electrical and magnetic fields meet the limit conditions. The tangential component of the electrical field is zero at the walls of the hollow conductor and the magnetic field is the maximum at the walls.

These microwave tubes are generally used in particle accelerator applications or for nuclear fusion. These fields require power values of the order of several megawatts and frequencies in the millimeter or submillimeter ranges.

2. Description of the Prior Art

When the frequency is as high as this, the amplitude of the electrical field, in a cross-section of the hollow conductor along the wall, has a plurality of maximum and minimum values. It then becomes difficult to connect the hollow conductor to a coupler enabling the extraction of the microwave energy from the tube in a mode enabling it to be used easily. Due to the high power, it becomes necessary for the element used as a coupler to be a guide whose diameter is too large in relation to the wavelength of the energy to be extracted. Its diameter represents several wavelengths and the guide is capable of conveying a very large number of modes of varying complexity in addition to the desired mode.

The frequencies and power values necessary for such applications have led the designers of the tubes to make tubes that give microwave power at output in a high-order mode with a complex structure and that convert it into quasi-optical beams. The high-order mode is of the TEm,n or TMm,n type (m and n are whole numbers, n being not zero; they represent respectively the azimuthal and radial indicators or index numbers). Generally, at least one of these indicators is greater than one.

In a quasi-optical beam, it is no longer possible to define any mode and the power density is the maximum in the vicinity of the axis of the beam. It decreases regularly with distance from this axis. In the form of a quasi-optical beam, the microwave energy can be conveyed over large distances with low losses. Mirrors are generally used to guide the quasi-optical beam.

This conversion is generally achieved in a so-called Vlasov-type coupler. It is formed by a waveguide section that receives the microwave energy in a high-order mode at a first end and yields the quasi-optical beam at a second end. The second end has a substantially helical aperture. The energy that comes out of the Vlasov coupler is intercepted by a mirror whose profile is chosen so as to focus this energy or guide it in a determined direction.

The essential limitation of this coupler is its low efficiency: it is of the order of 85%. This is due to the phenomenon of diffraction that occurs along the helical aperture of the waveguide section. The diffracted energy is not intercepted by the mirror and it is not used. It may even be a source of inconvenience if the coupler forms an integral part of a tube. The diffracted energy could get propagated towards the electron gun of the tube or towards the collector and lead to the destruction of certain parts of the tube.

SUMMARY OF THE INVENTION

The present invention is aimed at overcoming these drawbacks. It proposes a quasi-optical coupler with reduced diffraction. The efficiency of this coupler is appreciably greater than that of the standard Vlasov coupler. The efficiency of the coupler according to the invention may attain and even exceed 95%.

The present invention proposes a microwave coupler receiving microwave energy in a principal mode TEm,n (m and n being whole numbers and n being not zero) and giving this energy in the form of a quasi-optical beam. It has a radiator or radiating element having a first end by which there emerges the quasi-optical beam and a mode converter connected to a second end of the radiator. The mode converter receives the energy in the principal mode and converts a fraction of it into an auxiliary mode TEp,q (with p and q being whole numbers, q close to one and not zero, p greater than q) whose energy is concentrated in the vicinity of the wall of the mode converter. These two modes get propagated in the radiator. Furthermore, the first end of the radiator has an aperture that coincides with a minimum electrical field resulting from the superimposition of the electrical field of the principal mode and the electrical field of the auxiliary mode. Since this aperture coincides with a minimum electrical field, the diffraction of the quasi-optical beam is reduced along the aperture.

The mode converter will preferably be formed by a substantially cylindrical waveguide section whose internal surface has deformations generated by cubical spline functions. In a preferred variant, the deformations are substantially helical along the main axis of the waveguide section.

It is seen to it that the fraction of energy converted in the auxiliary mode is as small as possible for this energy is lost.

Preferably, the radiator is cut out of a substantially cylindrical waveguide section whose main axis is in the prolongation of the axis of the mode converter. Its diameter is substantially equal to that of the mode converter.

With this coupler, the quasi-optical beam emerges from the radiator in an oblique direction with respect to the axis of the radiator. If the coupler is integrated into a microwave tube and if an electron tube goes through the coupler along the axis of the coupler, then it is easy to separate the quasi-optical beam from the electron beam.

The present invention also relates to a microwave tube integrating a coupler such as this.

BRIEF DESCRIPTION OF THE DRAWINGS

Other advantages and characteristics of the invention shall appear from the following description, given by way of an example and illustrated by the appended figures, of which.

In all these figures, the same references designate the same element, but which may not be described in all the figures.

MORE DETAILED DESCRIPTION

Figure 1:
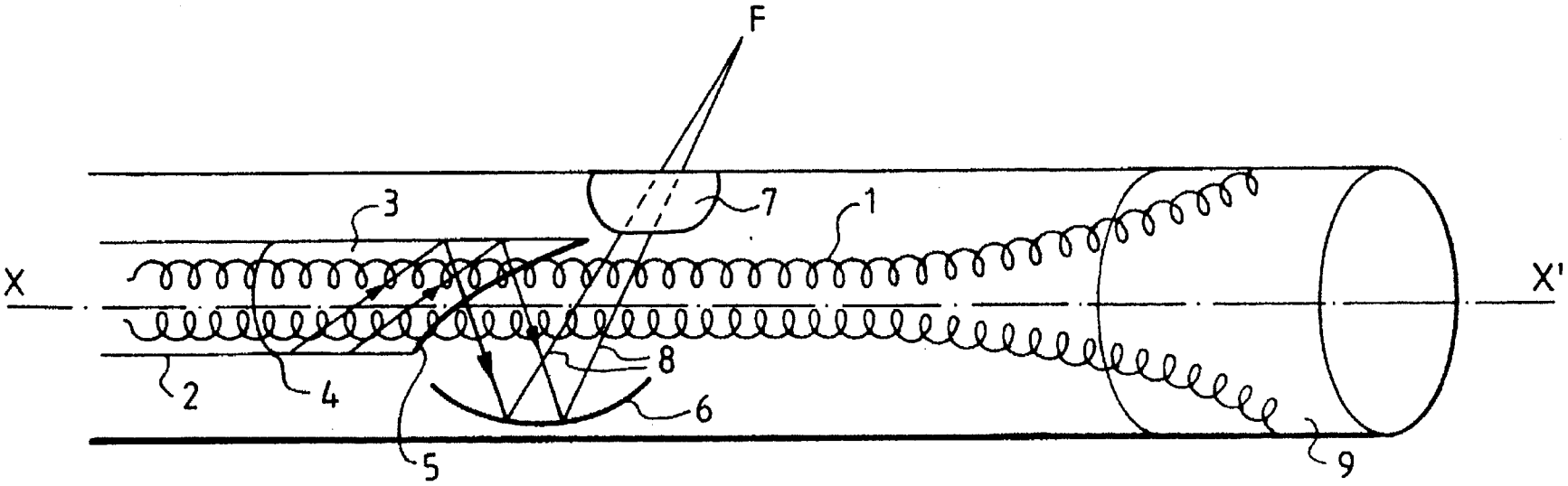
FIG. 1 PRIOR ART
FIG. 1 shows a so-called Vlasov quasi-optical coupler integrated into a prior art gyrotron.

FIG. 1 shows a quasi-optical Vlasov coupler integrated with the output of a gyrotron. The reference numeral 2 designates the output cavity of the gyrotron. It takes the form of a hollow, cylindrical conductor with a main axis XX'.

A high-order mode TE k,1 (with k and 1 as whole numbers, and 1 not zero), with at least one of the indicators being far greater than one, is generated in the cavity. This mode has a complex structure.

The Vlasov coupler referenced 3 prolongs the output cavity. It is formed by a circular waveguide section having the same diameter as the output cavity 2. Its first end 4 is connected to the cavity 2 while its second end 5 has a substantially helical aperture. The energy in the high-order mode enters the coupler through the first end at a certain angle. It will be converted into a quasi-optical beam. The quasi-optical beam is sent to a mirror 6 and is reflected towards a point F. This beam comes out of the tube in crossing a window 7. This window is airtight but lets through the microwaves. It is integrated into a lateral wall of the tube. The profile of the mirror 6 is adapted so as to focus the rays of the beam coming from the coupler with a same phase. The helical pitch of the aperture is of the order of the wavelength of the energy injected into the coupler.

An electron beam referenced 1, having the shape of a hollow cylinder, centered on the axis XX', comes out of the output cavity 2. It goes through the coupler 3 and is collected in a collector 9.

Figure 2:
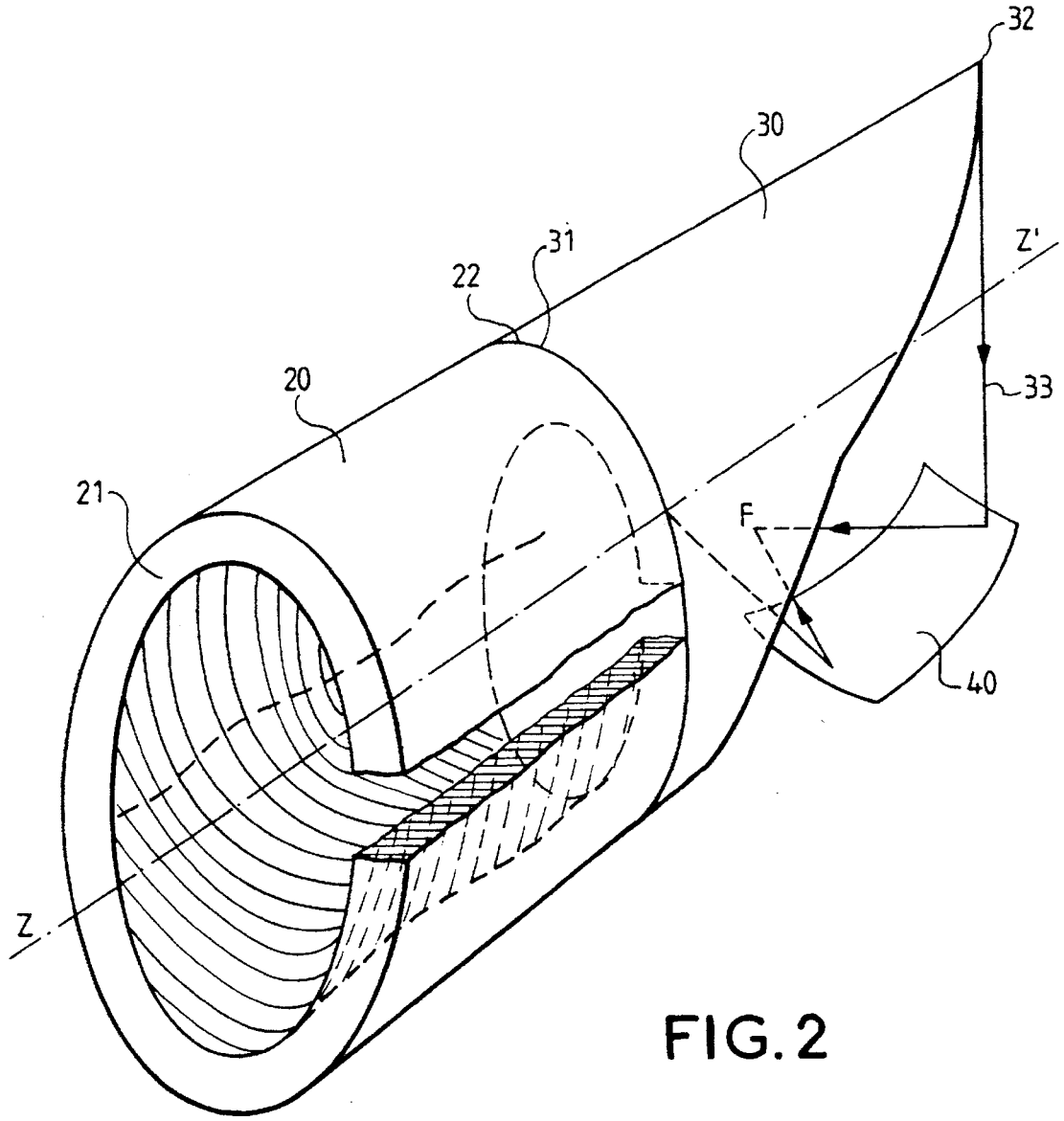
FIG. 2 shows a coupler according to the invention.

FIG. 2 shows a coupler according to the invention associated with a mirror.

This coupler has a first waveguide section 20 connected to a second waveguide section 30. The two sections are substantially circular with an axis ZZ' and have the same diameter. The second waveguide section 30 is a radiator.

The first waveguide section 20 is a mode converter. Through a first end 21, it receives microwave energy in a principle mode TEm,n, with m and n as whole numbers, n being not zero. Preferably, the mode is a high-order mode and at least one of the indicators is greater than one. This mode has a complex structure. It is of course possible to envisage the use of this coupler with simple modes. Its second end 22 is connected to a first end 31 of the second section 30. The other end 32 of the second section 30 radiates energy in the form of a quasi-optical beam 33. The quasi-optical beam 33 is intercepted by a mirror 40 which can focus the beam on a point F or direct it in a desired direction.

The mode converter is a waveguide section whose inner wall has deformations so as to convert a fraction of the principal mode to a TEp,q type auxiliary mode with p and q as whole numbers, q being close to unity and not zero and p being greater than q. This mode is known as the "whispering gallery" mode and its power density is concentrated close to the wall of the first waveguide section. Preferably, p is greater than m.

This auxiliary mode is generated in a small quantity of the order of some per cent (one or two per cent for example). Therefore, the auxiliary mode modifies the principal mode TEm,n only to a small degree. The energy corresponding to this auxiliary mode is not recovered.

To obtain a low percentage of the auxiliary mode, the internal surface of the mode converter 20 has deformations generated by cubical spline functions that shift rotationally and in translation about the main axis ZZ'. A spline function is a function formed by portions of polynomials that are linked to each other and by hundreds of their derivatives at the junction points. The cross-section of the mode converter is a third-degree closed curve.

An example of a deformation that is particularly interesting because it is relatively simple to obtain is the approximation, by cubical spline functions, of a helical function having the following form:

$$R = Ro\left(1 + \epsilon\cos\left(s\theta - \frac{2\pi}{\lambda B}z\right)\right)$$

R is the radius

θ is the angle between R and Ro z is the point along the z axis

Ro is the mean radius of the converter

ϵ is the relative amplitude of the deformation s is the absolute value of the difference between the azimuthal index of the principal mode and the azimuthal index of the auxiliary mode:

$$s = |m - p|$$

λB is the beat wavelength between the principal mode and the auxiliary mode. This value corresponds to the helical pitch.

Figure 3:
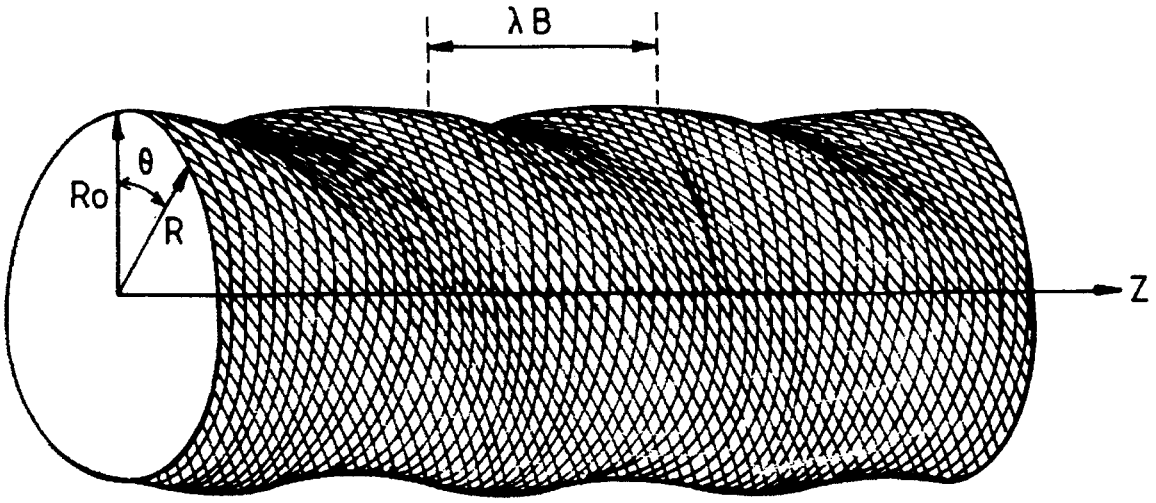
FIG. 3 shows an element whose external surface is identical to the internal surface of the mode converter belonging to the coupler according to the invention.

FIG. 3 shows an element whose external surface is identical to the internal surface of the mode converter 20. Its deformations are helical.

In the second waveguide section 30, the principal mode and the auxiliary mode are propagated while being superimposed. In a cross-section of the second waveguide section, the resulting electrical field has a succession of minimum and maximum values along the wall. There are s of them.

Each minimum value is represented by its angular position a(z) which varies as a function of its abscissa value z on the axis ZZ'.

$$\alpha(z) = \frac{1}{s}\left(\sqrt{\frac{\omega^2}{c^2} - \frac{\nu^2 mn}{a^2}} - \sqrt{\frac{\omega^2}{c^2} - \frac{\nu^2 pq}{a^2}}\right)\cdot z$$

with:

ω the pulsation rate in the second waveguide section;

c is the velocity of light;

a is the radius of the second waveguide section;

umn is the mode number of the principal mode;

upq is the mode number of the auxiliary mode.

It will be recalled that the mode number u of a mode in a circular waveguide with a radius a is:

$$\nu = 2\pi.a.fc/c$$

fc being the cut-off frequency of the mode considered.

It is seen to it that the second end 32 (See FIG. 2) of the second waveguide section 30 has an aperture that coincides with a minimum electrical field line. Since the aperture corresponds to a minimum electrical field, the diffraction is reduced.

Figure 4:
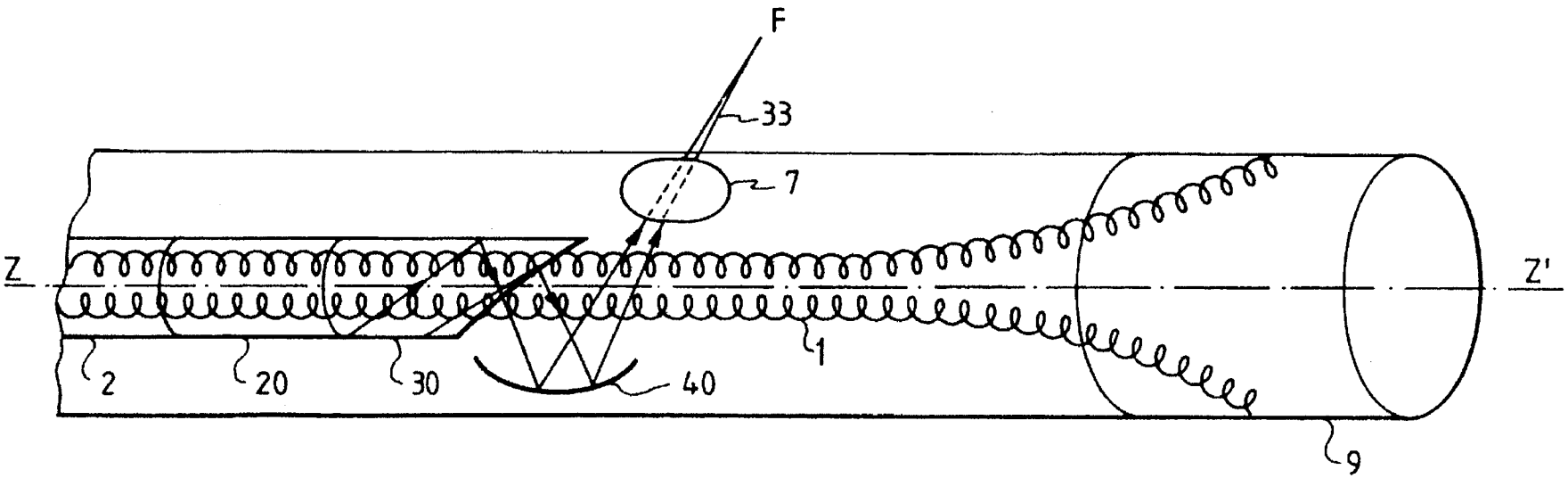
FIG. 4 shows a coupler according to the invention, integrated into a gyrotron.

In FIGS. 2 and 4 (FIG. 4 is described here below), the aperture of the radiator substantially follows a helix that verifies the relationship α (z), seen here above.

The energy balance of a standard Vlasov coupler in percentage points is 100-C1 if C1 represents the percentage of losses due to the diffraction at the aperture of the coupler.

The efficiency of the coupler according to the present invention is 100–((C1/k)+C2) if C2 is the percentage of auxiliary mode generated and not used and k is the ratio of reduction of the electrical field (i.e. the ratio of the mean amplitude of the electrical field in the second waveguide section to the minimum amplitude).

The greater the value of k, the higher the efficiency of the coupler according to the invention. The introduction of 1% of auxiliary mode may give an efficiency of 94% and even 98%. For example, with a principal mode $TE_{6,4}$ and an auxiliary mode $TE_{22,2}$, it is possible to achieve an efficiency of 94%.

The deformations to be obtained in the inner wall of the mode converter could be calculated by computer to generate the desired auxiliary mode.

It is possible to make a matrix having these deformations externally and use the electroforming technique, for example, to obtain the mode converter. Such a matrix will look like the illustration shown in FIG. 3, for example.

The coupler according to the invention can of course form an integral part of a microwave tube giving energy in a mode with a high-order complex structure.

FIG. 4 illustrates the case where the coupler according to the invention is integrated into a gyrotron.

The output cavity of the gyrotron referenced 2 is extended by the coupler according to the invention. Its different elements bear the same references as in FIG. 2. The quasi-optical beam 33 emerges from the radiator 30 in a direction that is oblique with respect to the main axis of the tube ZZ'. This axis is also the axis of the coupler according to the invention. The quasi-optical beam gets reflected on a mirror referenced 40, then goes through a window 7 before coming out of the tube. This window 7 is transparent to the quasi-optical beam but is sealed with respect to the internal vacuum of the gyrotron. It is placed on a lateral wall of the tube and is relatively distant from the electron beam referenced 1 pointed along the axis ZZ'. There is no risk of its being bombarded by the electrons. This coupler enables the quasi-optical beam 33 to be well separated from the electron beam 1.

The electron beam 1 comes out of the output cavity 2 of the gyrotron, goes through the coupler according to the invention and is collected in a collector 9 placed beyond the mirror 40 with respect to the radiator 30.

What is claimed is:

1. A microwave coupler receiving microwave energy in a principal mode TEm,n, m and n respectively being whole numbers and n not being zero, for producing a quasi-optical beam, said microwave coupler comprising:

a radiator having a first end which outputs the quasi-optical beam; and a mode converter connected to a second end of the radiator which receives said microwave energy in the principal mode and which converts a fraction of the microwave energy in the principal mode into an auxiliary mode TEp, q, with p and q respectively being whole numbers, q being close to one and not zero, and p being greater than, wherein, a power density of the microwave energy in the auxiliary mode is concentrated in the vicinity of an internal wall of the mode converter so that the microwave energy in the principal mode and in the auxiliary mode both propagate into the radiator, and wherein the first end of the radiator defines an aperture, said aperture has a position that coincides with a position of a minima of a composite electric field defined by a superimposition of an electric field of the principal mode microwave energy and an electric field of the auxiliary mode microwave energy.

2. A microwave coupler according to claim 1, wherein the mode converter comprises a substantially cylindrical waveguide section, wherein said internal wall has deformations disposed therein which correspond to cubical spline functions.

3. A coupler according to claim 2, wherein the deformations are helical.

4. A coupler according to one of the claims 1 to 3, wherein the fraction of energy converted into the auxiliary mode amounts to a small percentage of the microwave energy in the principal mode.

5. A coupler according to claim 2, wherein the radiator is a substantially cylindrical waveguide section having a main axis aligned along an axis of the mode converter.

6. A microwave coupler according to claim 5, wherein said radiator has a radiator diameter and said mode converter has a mode converter diameter, said radiator diameter is substantially equal to the mode converter diameter.

7. A microwave coupler according to claim 5, wherein said quasi-optical beam is outputted from the microwave coupler in a helical configuration.

8. A coupler according to claim 5, wherein the quasi-optical beam is outputted from the radiator in an oblique direction with respect to the main axis of the radiator.

* * * * *